US011187002B1

(12) United States Patent
Dascomb et al.

(10) Patent No.: US 11,187,002 B1
(45) Date of Patent: Nov. 30, 2021

(54) WAVE GENERATOR POOL WITH VARYING REEF ANGLES

(71) Applicant: Westlake Wave Co., Cardiff, CA (US)

(72) Inventors: John Dascomb, Cardiff, CA (US); Oriol Vicente, San Diego, CA (US)

(73) Assignee: Westlake Wave Co., Cardiff, CA (US)

( * ) Notice: Subject to any disclaimer, the term of this patent is extended or adjusted under 35 U.S.C. 154(b) by 0 days.

(21) Appl. No.: 17/246,860

(22) Filed: May 3, 2021

(51) Int. Cl.
*E04H 4/00* (2006.01)
*A63G 31/00* (2006.01)
*A63B 69/00* (2006.01)

(52) U.S. Cl.
CPC ..... *E04H 4/0006* (2013.01); *A63G 31/007* (2013.01); *A63B 69/0093* (2013.01)

(58) Field of Classification Search
CPC ..... E04H 4/0006; A63G 31/007
USPC ..... 4/491
See application file for complete search history.

(56) References Cited

U.S. PATENT DOCUMENTS

| | | | |
|---|---|---|---|
| 3,005,207 | A | 10/1961 | Matrai |
| 3,557,559 | A | 1/1971 | Barr |
| 4,276,661 | A | 7/1981 | Baker |
| 4,276,664 | A | 7/1981 | Baker |
| 4,692,949 | A | 9/1987 | Dunn |
| 5,105,094 | A | 4/1992 | Parker |
| 5,207,531 | A | 5/1993 | Ross |
| 5,621,925 | A | 4/1997 | Bastenhof |
| 6,920,651 | B2 | 7/2005 | Roberts |
| 7,497,643 | B2 | 3/2009 | Carnahan et al. |
| 7,862,292 | B2 | 1/2011 | Patterson |
| 8,366,347 | B2 | 2/2013 | Sagastume |
| 9,297,177 | B2 | 3/2016 | Fricano |
| 10,207,168 | B2 | 2/2019 | Bennett |
| 10,364,584 | B2 | 7/2019 | Sagastume |
| 10,378,225 | B1 | 8/2019 | Bennett |
| 10,858,851 | B2 | 12/2020 | Slater et al. |
| 2001/0014256 | A1 | 8/2001 | Carnahan et al. |
| 2008/0060123 | A1* | 3/2008 | Johnson ..... A63B 69/0093 4/491 |
| 2009/0151064 | A1* | 6/2009 | Mladick ..... E04H 4/0006 4/491 |
| 2010/0125943 | A1* | 5/2010 | Lochtefeld ..... E04H 4/0006 4/491 |
| 2017/0080348 | A1 | 3/2017 | Mladick |
| 2018/0147469 | A1 | 5/2018 | Bennett et al. |

(Continued)

*Primary Examiner* — Lauren A Crane
(74) *Attorney, Agent, or Firm* — Arc IP Law, PC; Joseph J. Mayo

(57) ABSTRACT

A wave generator pool that may be used for surfing, which has reefs configured to provide a variety of novel wave shapes. Reefs may have multiple sections with varying angles, causing the shape or direction of the wave to change as a surfer rides the wave. One or more embodiments of the pool may have two basins that share a common wave generator, resulting in substantial energy savings. An illustrative dual basin pool may have an intermediate basin on one side and a beginner basin on the other. The intermediate basin may have an easy takeoff reef section with a reef angle between 65 and 85 degrees. The beginner basin may have several isolated takeoff reef sections where a corresponding number of surfers can await a wave. Reefs may be constructed and reconfigured using a modular reef structure that avoids the months of downtime associated with rebuilding fixed reefs.

18 Claims, 14 Drawing Sheets

(56) References Cited

U.S. PATENT DOCUMENTS

| | | | |
|---|---|---|---|
| 2019/0226223 | A1 | 7/2019 | Slater et al. |
| 2019/0323249 | A1 | 10/2019 | Grantham et al. |

* cited by examiner

WAVE GENERATOR POOL WITH VARYING REEF ANGLES

BACKGROUND OF THE INVENTION

Field of the Invention

One or more embodiments of the invention are related to the field of facilities and equipment for water sports, such as surfing. More particularly, but not by way of limitation, one or more embodiments of the invention enable a wave generator pool with varying reef angles.

Description of the Related Art

Wave generator pools are known in the art, and are commonly used for surfing. Typical wave pools have a wave generator that makes waves, and some type of underwater reef structure that causes the waves to break. Although these existing pools generate waves that can be used for surfing, the types of waves that are generated are limited. For example, many pools use reefs with relatively small "reef angles" (defined below in the specification), and reef angles vary little or not at all along the reef. As a result, the wave quality of the waves generated in these pools is not ideal, particularly for intermediate and advanced surfers. In addition, reefs are typically constructed along with the basin as permanent structures. It is therefore prohibitively expensive and time-consuming to modify reef structures to provide different wave experiences at different times.

An illustrative existing wave pool design is described in U.S. Utility Pat. No. 10,364,584, "Wave generator system with a lateral moving wave barrier for the generation of waves in two areas of water." This patent teaches reef angles of at most 20 degrees, with reefs that are structures integrated into the pool floor. The type of waves generated and the ability to modify waves are therefore limited in this type of design.

For at least the limitations described above there is a need for a wave generator pool with varying reef angles.

BRIEF SUMMARY OF THE INVENTION

One or more embodiments described in the specification are related to a wave generator pool with varying reef angles. Embodiments of the invention may be used for example for surfing or other water activities. Embodiments may have reefs with shapes and structures that are unknown in the art.

One or more embodiments of the invention include one or more basins that are configured to contain water or a similar liquid. A wave generation mechanism, which may be shared across multiple basins in one or more embodiments, may have one or more moveable paddles configured to be at least partially submerged in water, and one or more actuators that move the paddles to generate a wave in each basin. The pool may have a horizontal plane, and a longitudinal axis associated with the paddles that lies in the horizontal plane. Waves may travel along a wave propagation axis. Each basin may have a reef coupled to, or which is part of a portion of the basin floor, which generates a change in the wave when water reaches the reef. The reef may have one or more reef sections, each with a wave-facing surface in contact with the water. At each point of this wave facing surface there is a tangent plane to the surface. The reef angle associated with each point is the angle between the line of intersection between the tangent plane and the horizontal plane, and the longitudinal axis. The reef incline angle is the angle between the tangent plane and the horizontal plane. Reef angles and reef incline angles are between 0 and 90 degrees, inclusive.

In one or more embodiments, there may be a first basin with an associated first reef. This first reef may have multiple reef sections, including (but not limited to) a first section closest to the paddles, and a second section further from the paddles. The first section may have a first reef angle and a first reef incline angle associated with a point on the wave-facing surface of the first section, and the second section may have a second reef angle and a second reef incline angle associated with a point on the wave-facing surface of the second section.

In one or more embodiments, the first reef angle may be between 0 and 20 degrees, inclusive, and the second reef may be between 65 and 85 degrees, inclusive.

In one or more embodiments the first reef incline angle may be between 10 and 20 degrees, inclusive, and the second reef incline angle may be between 3 degrees and 15 degrees, inclusive.

In one or more embodiments, the second reef angle may be between 75 and 80 degrees, inclusive. For example, it may be 78 degrees.

In one or more embodiments, the first reef angle may be 0 degrees.

In one or more embodiments, the first reef may have one or more subsequent reef sections further from the paddles than the second reef section, and the average reef angle across these subsequent sections may be between 50 and 65 degrees, inclusive. In one or more embodiments the average reef incline angle across these subsequent sections may be between 3 degrees and 10 degrees, inclusive.

One or more embodiments may have two basins on either side of the paddles. The actuators may move the paddles in both directions along the wave propagation axis to generate waves in both basins.

In one or more embodiments with two basins, the shape of the reef in the first basin may be different from the shape of the reef in the second basin.

In one or more embodiments, the reef of the second basin may have multiple reef sections that include multiple takeoff reef sections. These takeoff sections may be substantially the same shape, substantially equidistant from the paddles, and isolated from each other and from other reef sections. The reef angle associated with each takeoff section may be for example 0 degrees, and the reef incline angle may be between 5 and 20 degrees, inclusive. There may be an additional reef section further from the paddles than the takeoff sections. This additional reef section may have a reef angle of 0 degrees and a reef incline angle between 0 and 10 degrees, inclusive.

In one or more embodiments of the invention, one or more reef sections associated with at least one basin may have a frame that is detachably coupled to the basin floor, and multiple tiles detachably coupled to the frame. The frame may be detachably coupled to one or more channels integrated into or coupled to the basin floor. Each tile may have one or more padding elements that have rubber or foam. The frame may have one or more slots, and the tiles may have a bottom layer with tabs that slide into the slots and detachably lock into place. In one or more embodiments, all of the reef sections of all of the basins may be made of these frames and tiles.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION OF THE INVENTION

A wave generator pool with varying reef angles will now be described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Figures 1A, 1B, 1C:
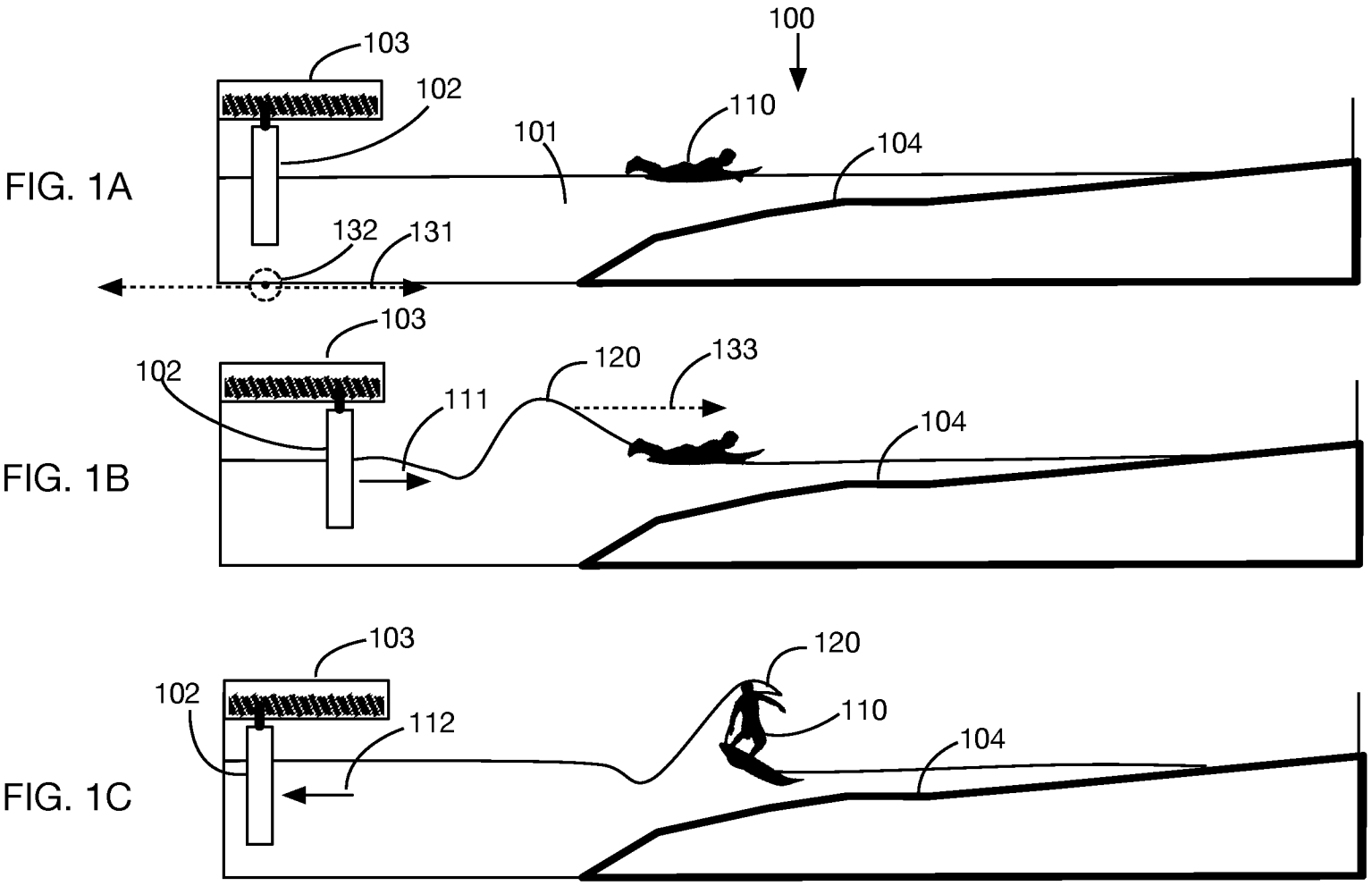
FIGS. 1A, 1B, and 1C show elements of an illustrative wave generator pool, including an actuator that generates waves, and a reef structure that shapes the wave.

FIGS. 1A through 1C show side views of an illustrative embodiment 100 of the invention. This embodiment is a wave pool that may be used for example for surfing or for other water sports or activities. The pool may be used for example for training, for recreation, for performances, or for competitions. The pool is filled with water 101 (or a similar liquid). It contains one or more wave generators that may for example each have one or more moveable paddles 102 or other structures that are fully or partially submerged in the water, and one or more actuators 103 that move the paddles 102 or other structures to initiate a wave. A wave pool may contain multiple wave generators that may act together to create a wave. These multiple generators may be roughly collinear in one or more embodiments. Any type or types of actuators may be used, such as pistons, electric motors, linear actuators, rack and pinion systems, or belt or cable driven systems.

For reference in the remainder of this application, FIGS. 1A and 1B show a horizontal plane 131, which may be perpendicular to the gravity vector (and may in some cases coincide with the basin floor if this floor is level), a longitudinal axis 132 (which is perpendicular to the surface of the page in this side view) that lies in the horizontal plane 131, and that is along the direction of the row of paddles or other wave generating structures, and a wave propagation axis 133 that is the initial direction of a wave 120 generated when the paddles create a wave. In some embodiments the wave propagation axis 133 may be roughly parallel to horizontal plane 131, and the projection of this axis 133 onto horizontal plane 131 may be roughly perpendicular to the longitudinal axis 132.

Illustrative wave pool 100 has a reef 104 that is partially or fully submerged in water 101. The shape of the reef affects the type of waves created in the wave pool. As described below, the inventors have experimented with many potential reef shapes, and have discovered specific reef shapes unknown in the art that create desirable types of waves. In some situations the combinations of particular paddle motions and particular reef shapes contribute to desirable wave formation. In many cases the inventors have discovered that reefs with different sections that have varying angles for the reef faces are desirable; examples are illustrated below.

FIG. 1A shows wave pool 100 before generation of a wave. Water 101 is still, and a surfer 110 is waiting for a wave. In FIG. 1B, actuators 103 moves paddles 102 in a forward direction 111, towards the reef structure 104, which generates a wave 120 travelling in wave propagation direction 133. In FIG. 1C, wave 120 reaches a section of reef 104 that causes it to break, and surfer 110 rides the wave. Actuators 103 move paddles 102 in a backwards direction 112 to prepare for generation of another wave.

Figure 2:
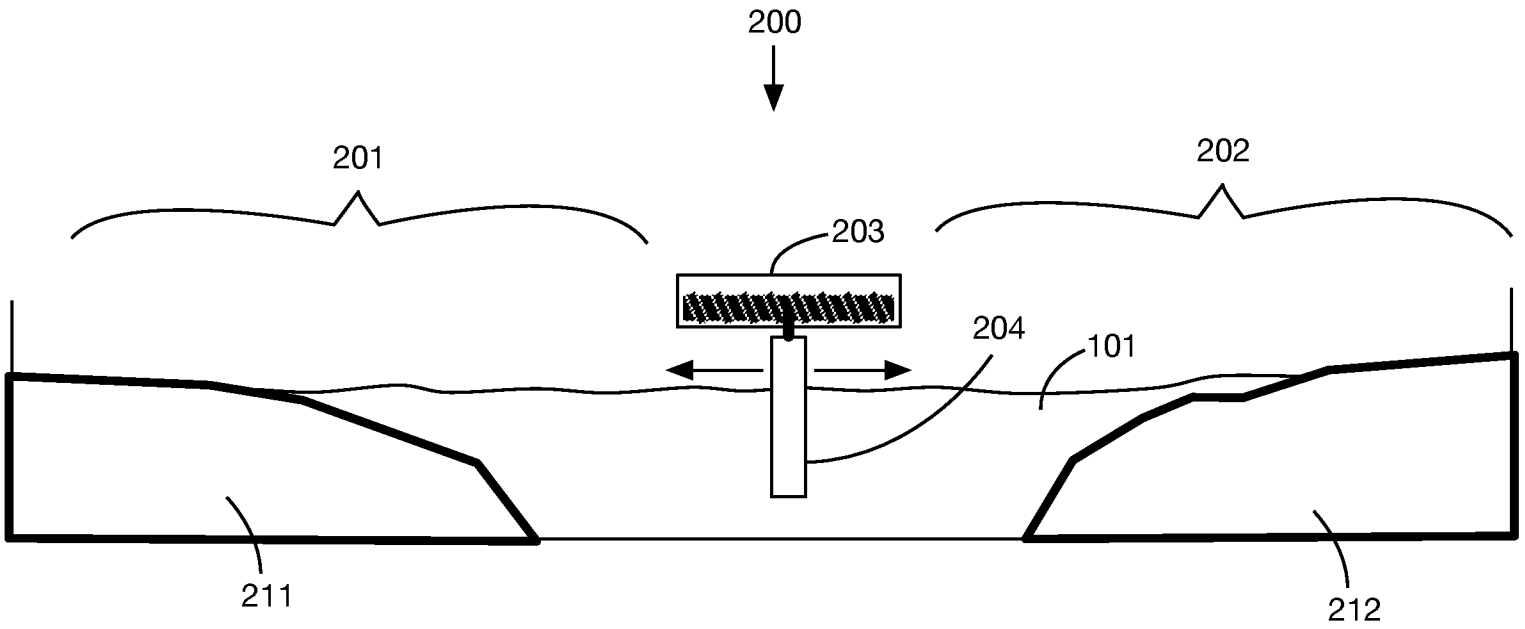
FIG. 2 shows elements of an illustrative embodiment of the invention with two basins that share a common wave generator; the two basins may have different reef structures to create differently shaped waves in the two basins.

FIGS. 1A through 1C illustrate a wave pool with a single basin. One or more embodiments of the invention may have a wave pool with multiple basins. FIG. 2 shows an illustrative embodiment 200 of a wave pool with two basins 201 and 202, with associated reef structures 211 and 212 (which may be different). These two basins may share a single set of paddles 204 and actuators 203. Use of a single set of actuators for multiple basins may result in substantial energy savings compared to using separate actuators for each basin, since the retraction of paddles 204 from one direction can generate a wave in the opposite direction in another basin. Use of paddles with water behind the paddles also reduces the force needed to push the paddles when generating a wave, further reducing energy costs. Other costs may also be reduced in a multiple basin wave pool, such as for example maintenance costs, water costs, and land costs. In one or more embodiments, the reef structures associated with different basins may have different shapes, allowing each basin to have a distinctive type of wave; for example, as described below, one basin may be configured for "beginner" surfers, with smaller and simpler waves, and another may be configured for intermediate or advanced surfers, with larger and harder to surf waves. The motion of paddles to generate waves in the two basins may also be different in one or more embodiments, further contributing to different types of waves in the two basins. The attractiveness of a multiple basin facility may be enhanced by offering more variety in wave types.

Figures 3A, 3B, 3C, 3D:
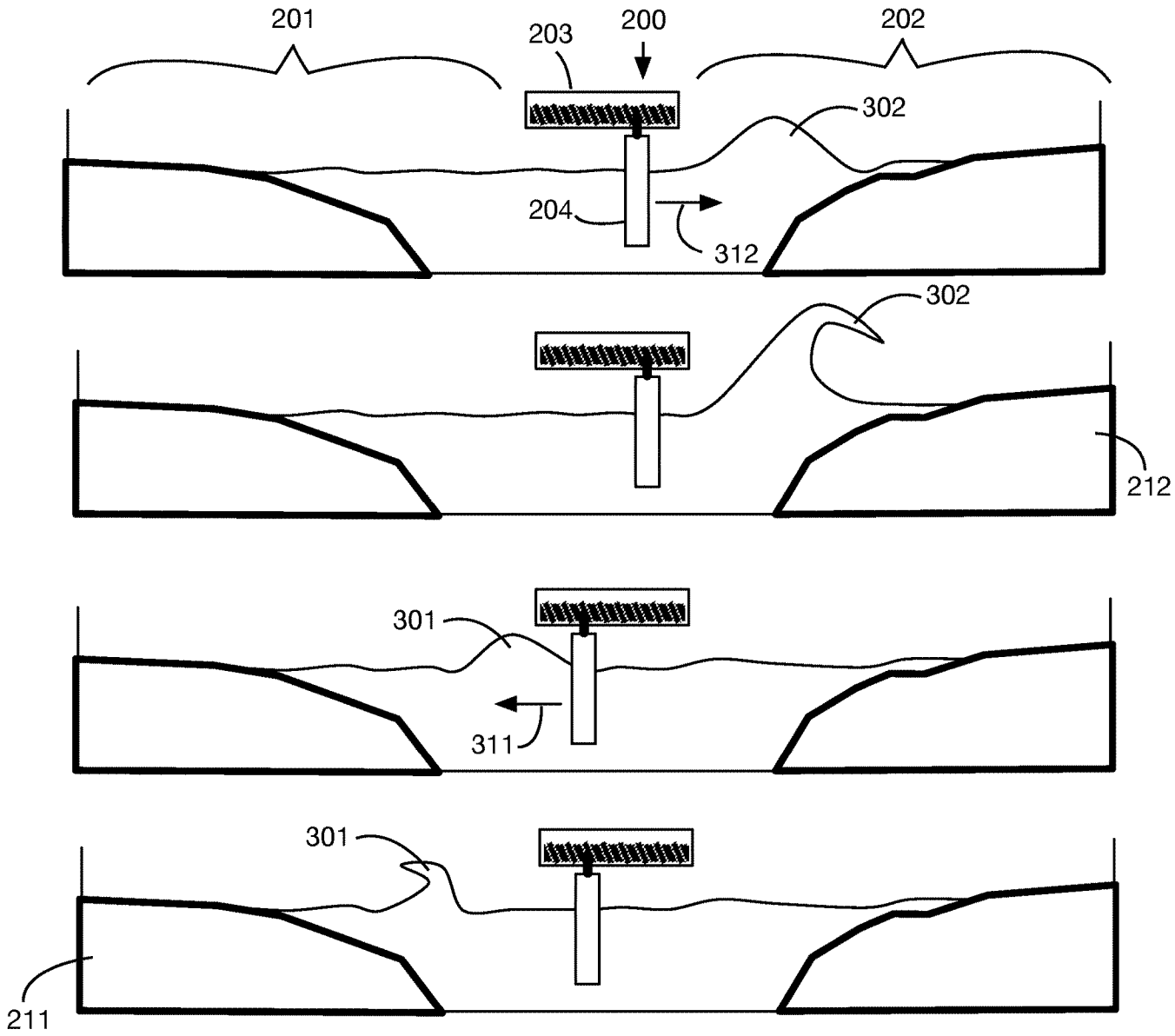
FIGS. 3A through 3D illustrate the operation of the dual basin wave pool of FIG. 2.

FIGS. 3A through 3C show illustrative operation of the dual basin pool 200 of FIG. 2. In FIG. 3A, actuators 203 move paddles 204 in the direction 312, to generate a wave 302 in basin 202. In FIG. 3B, this wave 302 encounters the reef 212 of basin 202, and the wave breaks or otherwise changes its size, shape, or direction. In FIG. 3C, actuators 203 move paddles 204 in the opposite direction 311, generating a wave 301 in basin 201, and in FIG. 3D, this wave 301 encounters the reef 211 of basin 201, and the wave breaks or otherwise changes its size, shape, or direction. The wave 301 in basin 201 may differ substantially from wave 302 in basin 202 due to the different shapes of reefs 211 and 212, and potentially also due to differences in the motion of paddles 204 in direction 311 and direction 312.

Figure 4:
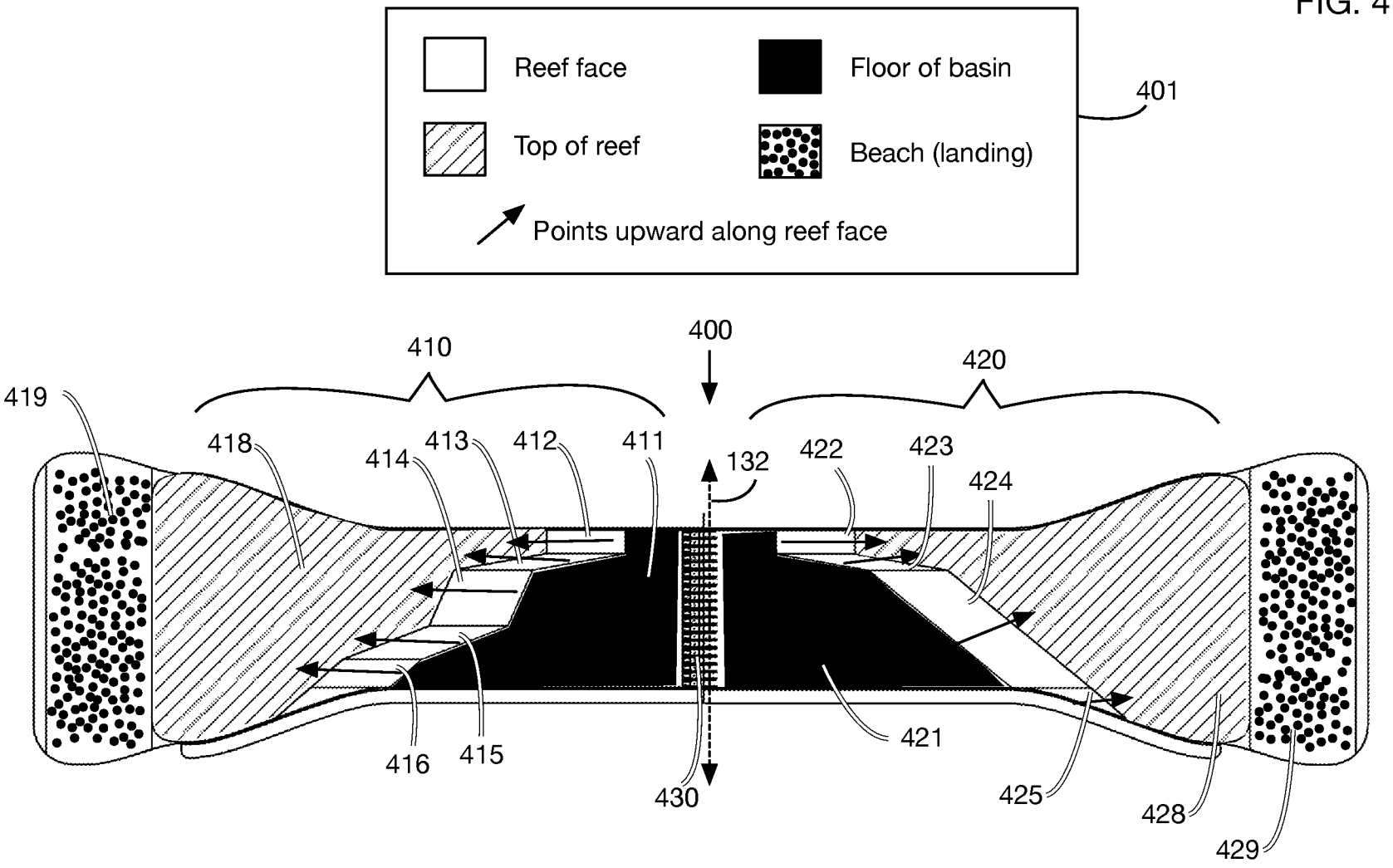
FIG. 4 shows a top view of an illustrative dual basin wave pool with different reef structures in each basin.

FIG. 4 shows a top view of an illustrative embodiment 400 of the invention, with two basins 410 and 420 and a shared set 430 of paddles and actuators between the basins. (In one or more embodiments, there may be for example a bridge over the paddles and actuators 430 so that users can walk from one side of the pool to the other. Users may also enter the basins near the paddles, so that they do not have to swim out to catch the waves.) Legend 401 indicates shading associated with the basin floor, the reef section faces that face an arriving wave, the top of the reef sections, and the "beach" areas where surfers or other users may land after riding a wave. The direction upward on each reef face (from the floor of the basin towards the top) is indicated with an arrow. This shading is also used in several subsequent figures.

The reefs of basins 410 and 420 each consist of two or more sections. (More generally embodiments of the invention may have any number of reef sections associated with any basin, including for example, one section, two sections, three sections, or more than three sections.) Each section may have an associated reef face, which is the wave-facing surface that is in contact with the water. This surface may in general be of any shape; the reef sections shown in FIG. 4 have flat faces, but in one or more embodiments some or all of the reef sections may have curved faces. Associated with each point of each reef face are two angles related to the tangent plane to the reef face surface at that point, as described below with respect to FIG. 7: the reef angle, and the reef incline angle. For a reef face that is flat, each point of that face is associated with the same reef angle and reef incline angle, because the face itself is in the tangent plane. If the basin floor is flat and level and the reef face is flat (as in the embodiment shown in FIG. 4), then the reef angle is the angle between the longitudinal axis 132 (which is vertical in FIG. 4) and the line through the intersection of the reef face and the basin floor. (More generally the reef angle may be defined using the intersection of a reef face tangent plane with the horizontal plane, as described with respect to FIG. 7.)

In basin 410, the reef has five sections with faces 412, 413, 414, 415, and 416. The basin floor 411 is level. The top 418 of the reef extends to the beach 419. In basin 420, the reef has four sections with faces 422, 423, 424, and 425. The basin floor 421 is level. The top 428 of the reef extends to the beach 429. The orientation of the reef sections in basin 410 is mirrored compared to that of basin 420. Therefore, waves in basin 410 have a pocket that moves from right to left (from the perspective of the surfer), while waves in basin 420 have a pocket that moves from left to right. These mirrored wave orientations provide more variety for surfers.

These configurations are illustrative; one or more embodiments may use any desired reef configuration for any basin. For a dual basin, the two reefs associated with the two basins may be identical, or different as in FIG. 4. The reefs may be identical, but of different orientations. The reef sections for each basin 410 and 420 are contiguous; in one or more embodiments, one or more reef sections may be isolated rather than touching other reef sections along the entire edges of their reef faces. In one or more embodiments, one or more reef sections may have both underwater and above water features (thereby becoming "islands" as well as reefs).

Figure 5:
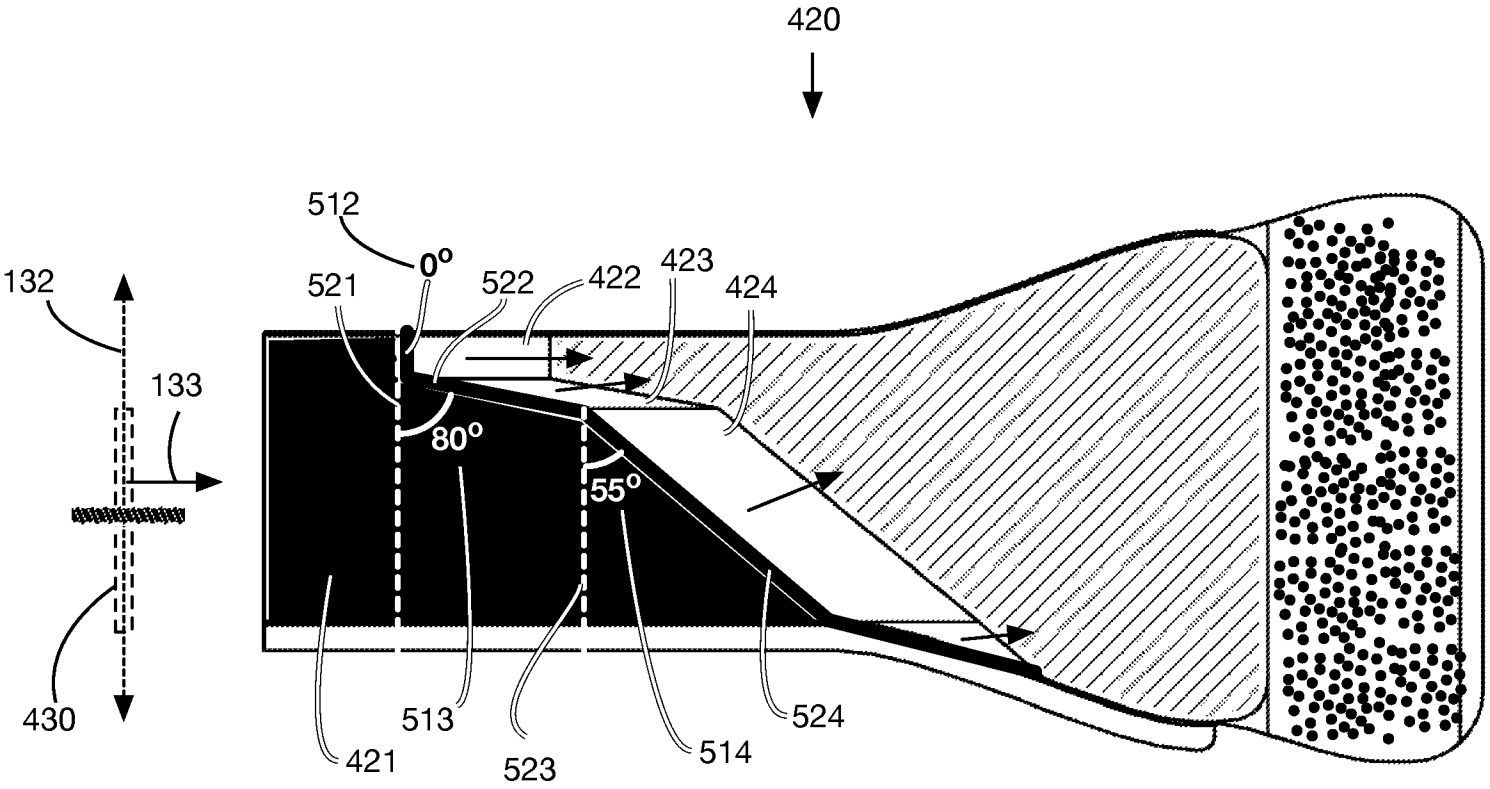
FIG. 5 shows illustrative reef angles of the reef structure of one of the basins of the embodiment of FIG. 4; these reef angles vary in different reef sections.

FIG. 5 shows reef angles associated with sections of the reef of illustrative basin 420. Reef angles are shown relative to line segments parallel to the longitudinal axis 132. (The convention used in this application is that reef angle is the smaller angle—an acute or right angle of the angles formed by the intersection of the tangent plane with the horizontal plane, and the longitudinal axis 132. Therefore the reef angle is always between 0 degrees and 90 degrees, inclusive.) Paddles and actuators 430 generate waves in this basin that move in the direction 133, which in this embodiment is perpendicular to the longitudinal axis 132. The first reef section 422, which is closer to paddles and actuators 430 than the other sections, has a reef angle 512 of 0 degrees; in other words the reef face directly faces the incoming wave. This section may cause the wave to start breaking when it hits the reef face, for example. In one or more embodiments this first section may have a reef angle between 0 degrees and 20 degrees, inclusive. The second reef section 423 has a reef angle 513 of 80 degrees, which is the angle between segment 521 parallel to longitudinal axis 132 and segment 522 at the base of the reef face. (In this basin 420, the basin floor 421 is flat and level, so it coincides with the horizontal plane.) In one or more embodiments this second section may have a reef angle between 65 degrees and 85 degrees, inclusive. The inventors have discovered that a section with a reef angle in this range generates a wave shape that allows for an "easy takeoff" for surfers, because the large reef angle reduces the lateral movement of the "pocket" of the wave. Beginners usually are not very skilled in quickly turning laterally with a fast moving pocket while simultaneously trying to stand up. Reducing the lateral movement allows beginners to first focus on standing up, then turning laterally. In one or more embodiments, the reef angle of this second section may be between 75 degrees and 80 degrees, inclusive; for example, this reef angle may be 78 degrees.

In one or more embodiments, there may be one or more additional reef sections that are further from the paddles than the first two reef sections. The average reef angle across these subsequent sections may be for example between 50 degrees and 65 degrees, inclusive. In the illustrative basin 420, the third reef section 424 has a reef angle 514 of 55 degrees, which is the angle between segment 523 parallel to longitudinal axis 132 and the base of the reef face 524. More advanced surfers may prefer a shallower reef angle closer to 50 degrees, while beginners may prefer a larger reef angle of 65 degrees. A reef angle between these values may therefore accommodate a wide variety of surfers.

Figure 6:
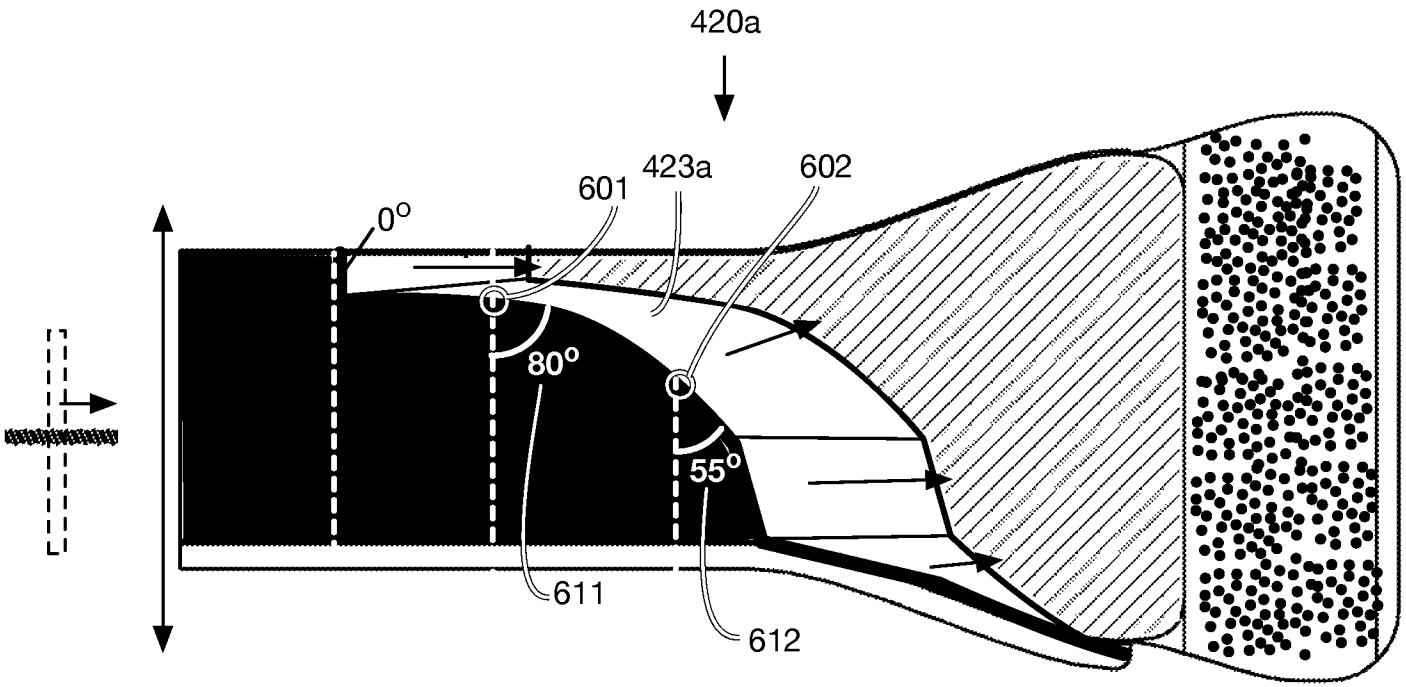
FIG. 6 shows an illustrative embodiment of the invention with a curved reef section with reef angles that vary continuously across the section.

In one or more embodiments, one or more of the basins may have one or more reef sections with curved reef faces, where angles may vary continuously throughout a portion of the face. FIG. 6 shows an illustrative basin 420*a* with a curved reef face 423*a*. At point 601 on the reef face, the reef angle 611 is 80 degrees; at point 602 on the reef face, the reef angle 612 is 55 degrees. Curved reef faces may have any desired shape; reef angles may for example decrease or increase in any portion of the reef face.

A benefit of using reef sections with varying reef angles is that the speed of the wave "pocket" changes as it encounters reefs sections with different angles. The swell speed in the direction of wave propagation is unchanged, but the "pocket" where it is best to surf changes speed. More advanced surfers often desire a faster moving pocket. Varying reef angles allow for the pocket speed to change, allowing for a variety of surfing maneuvers. For example, some maneuvers, such as a cutback, are best done at low pocket speeds; other maneuvers like floaters are best done at high pocket speeds.

Figure 7:
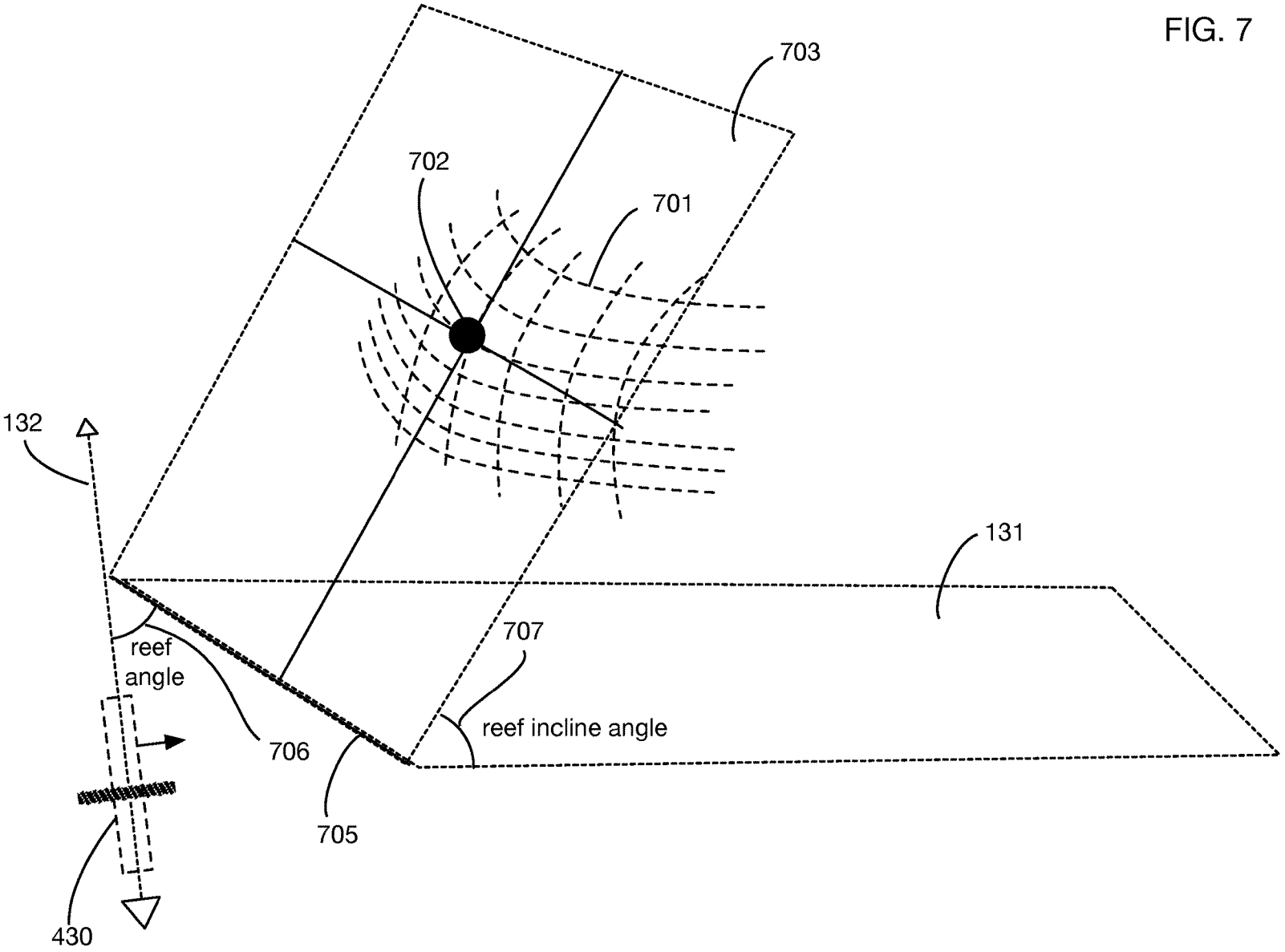
FIG. 7 shows general definitions of the reef angle and reef incline angle at any point of a reef section face.

FIG. 7 shows a general definition of the reef angle and reef incline angle associated with any point 702 of a reef section face 701. The face 701 may be curved or flat. At each point 702 there is a tangent plane 703 that is tangent to the reef face surface 701 at that point. (If the reef face is flat, the tangent plane contains the entire reef face.) The tangent plane 703 intersects the horizontal plane 131 along a line 705. The reef angle 706 is the smaller nonnegative angle (between 0 and 90 degrees) between this line 705 and the longitudinal axis 132. The reef incline angle 707 is defined as the angle between tangent plane 703 and horizontal plane 131. Both the reef angle 706 and the reef incline angle 707 may affect the shape of the wave when it hits the reef face 701.

Figure 8:
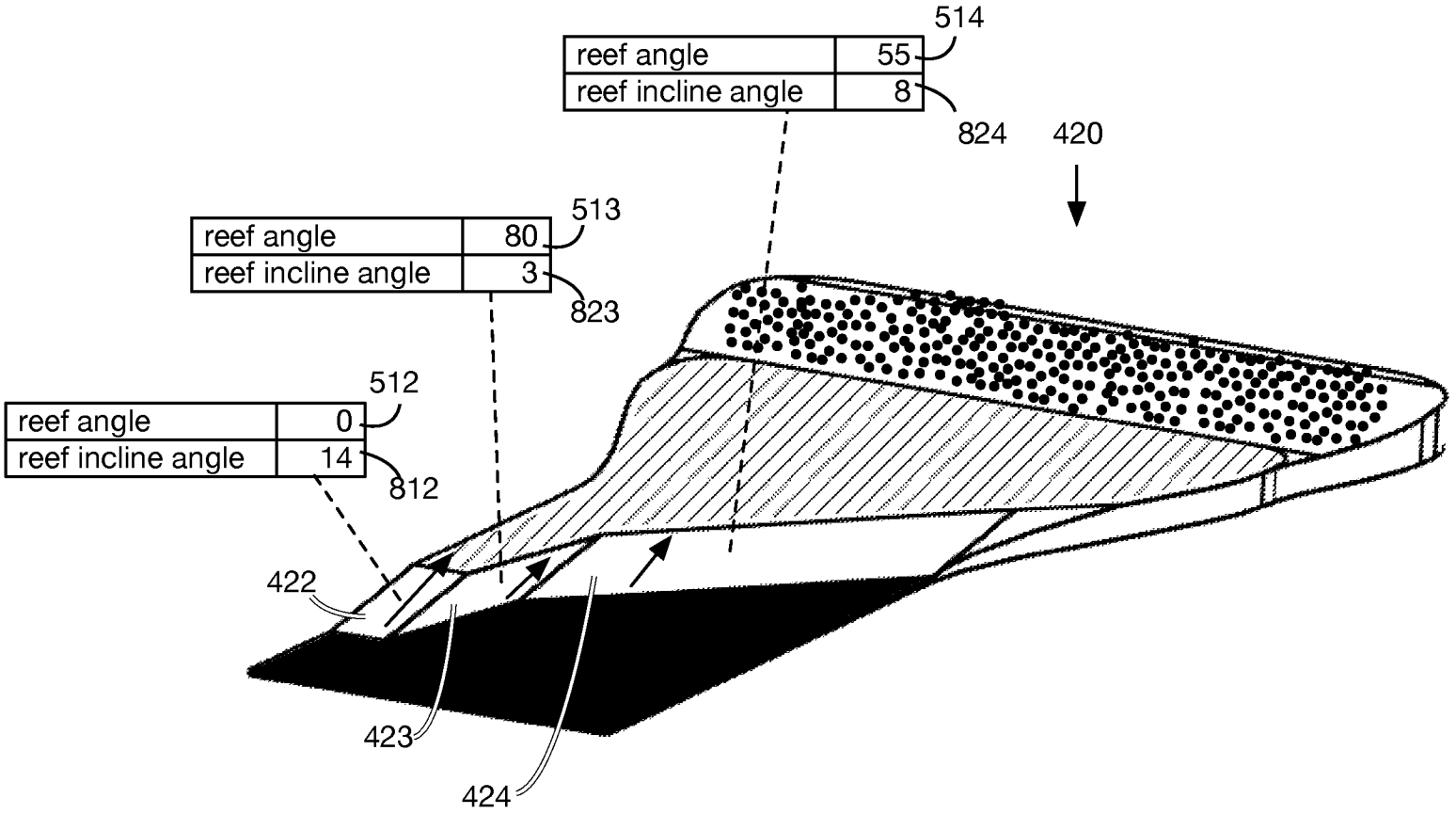
FIG. 8 shows a perspective view of the reef structure of FIG. 5, with the reef angle and reef incline angle for each reef section.

The inventors have experimented with and simulated a large number of reef angles and reef incline angles to find combinations that generate desirable waves. FIG. 8 shows a perspective view of illustrative basin 420, and shows the reef angles and reef incline angles for the faces of reef sections 422, 423, and 424. The first reef section 422 (closest to the paddles) has reef angle 512 of 0 degrees, and reef incline angle 812 of 14 degrees. In one or more embodiments, the reef incline angle of the first reef section may be between 10 degrees and 20 degrees, inclusive. The second reef section 423 (second closest to the paddles) has a reef angle 513 of 80 degrees, and a reef incline angle 823 of 3 degrees. In one or more embodiments, the reef incline angle of the second reef section may be between 3 degrees and 15 degrees, inclusive. The third reef section 424 has a reef angle 514 of 55 degrees, and a reef incline angle 824 of 8 degrees. In one or more embodiments, the subsequent reef sections after the second section may have an average reef incline angle between 3 degrees and 10 degrees, inclusive.

Figure 9:
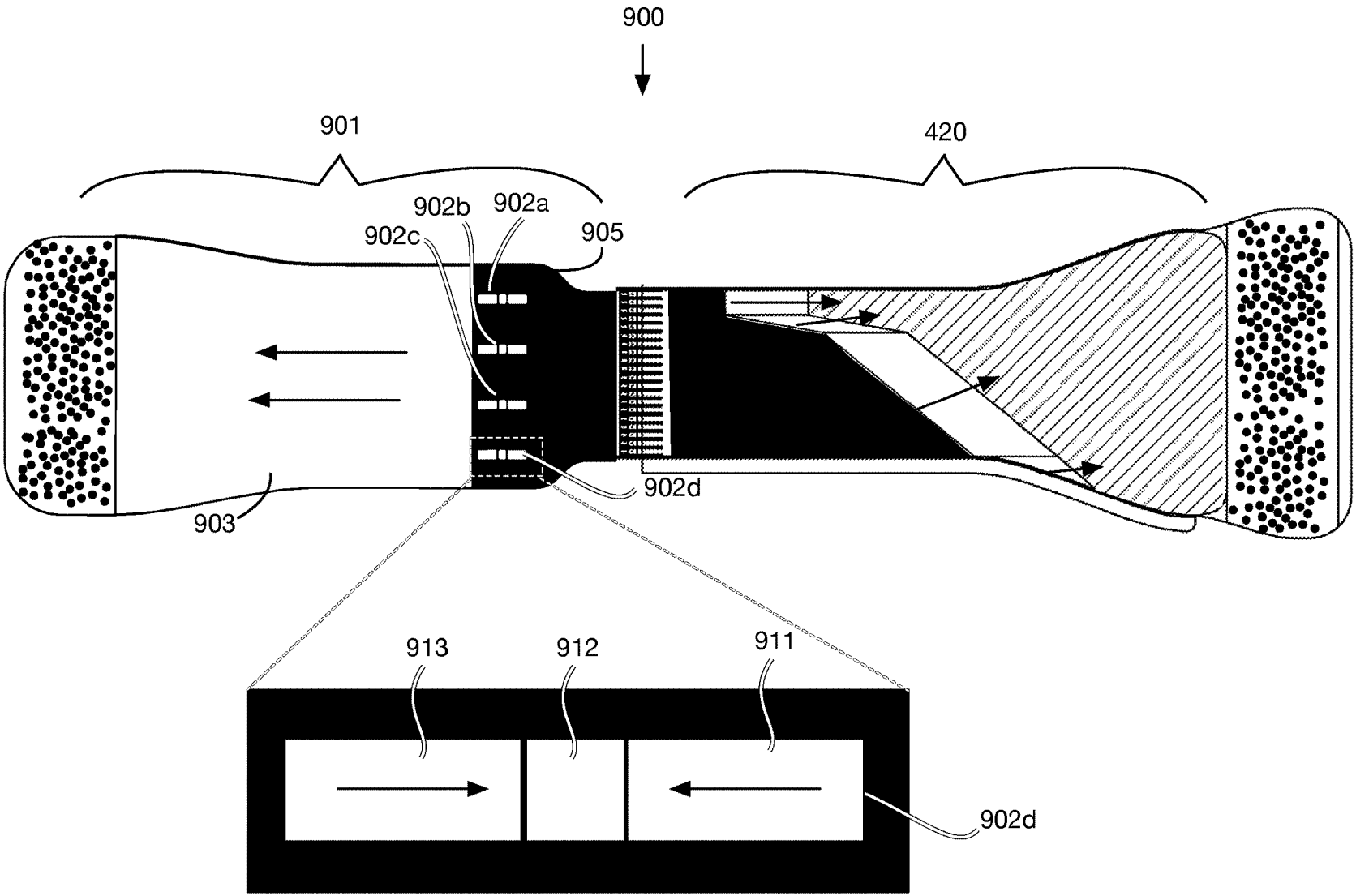
FIG. 9 shows a top view of an embodiment of the invention with dual basins, where one basin is configured for an "intermediate" skill level and the other is configured for a "beginner" skill level.

Basin 420 may be an "intermediate level" basin, with waves that are optimized for intermediate (or advanced) surfers. One or more embodiments of the invention may have one or more "beginner level" basins that are optimized for beginning or lower skilled or inexperienced surfers. Wave pools with multiple basins may for example combine an intermediate basin and a beginner basin. This combination is illustrated in FIG. 9. Wave pool 900 has intermediate basin 420, as described above, and a beginner basin 901. Waves for both basins are generated from a shared set of paddles and actuators. Beginner basin 901 has several features that contribute to generation of waves that are suitable for beginners. First, the width of basin 901 increases in zone 905, causing the wave generated by the paddles to spread out and decrease in height. Second, there are four isolated reef sections 902*a* through 902*d* that are closest to the paddles, and are roughly equidistant from the paddles. These sections 902*a* through 902*d* are roughly the same size and shape, and are roughly equidistant from the paddles. These sections 902*a* through 902*d* are isolated from one another because at all or part of each section is not in contact with any of the others. A closeup view of isolated reef section 902*d* shows that it has an upward sloping face 911, a small horizontal portion 912, and a downward sloping face 913. There are gaps between these sections. (In one or more embodiments, there may be a shallower reef section that is between the bases of these isolated reef sections, but this shallower section may for example be less than half the height of the maximum height of the isolated reef sections.) The wave encounters these reef sections first, and it breaks in the small portions of the wave that hit these reefs. The remainder of the wave does not break until it encounters the next reef section 903. The isolated reef sections can therefore be used as takeoff zones where multiple surfers can wait for an incoming wave; because the takeoff reef sections 902*a* through 902*d* are isolated, the waiting surfers are naturally spread out along the wave. This spacing of surfers may be beneficial for beginners, and it may assist in increasing the capacity of the wave pool since several surfers can safely catch the same wave each time.

Illustrative specifications for an embodiment of dual basin wave pool 900 may be as follows: The width of the pool at the wave generators may be 20 meters, and the width of the beach areas may be 40 meters. The total length of both basins (excluding the beach areas) may be 160 meters. The total water volume contained in both basins may be 1.5 million gallons. Beginner basin 901 may generate 120 waves per hour, with a capacity of 3 to 4 riders per wave. The ride time of each wave may be 10 seconds. Intermediate basin 420 may generate 200 waves per hour, with 1 rider per wave, and a ride time for each wave of 8 seconds. These specifications are illustrative and one or more embodiments may have different specifications.

Figure 10:
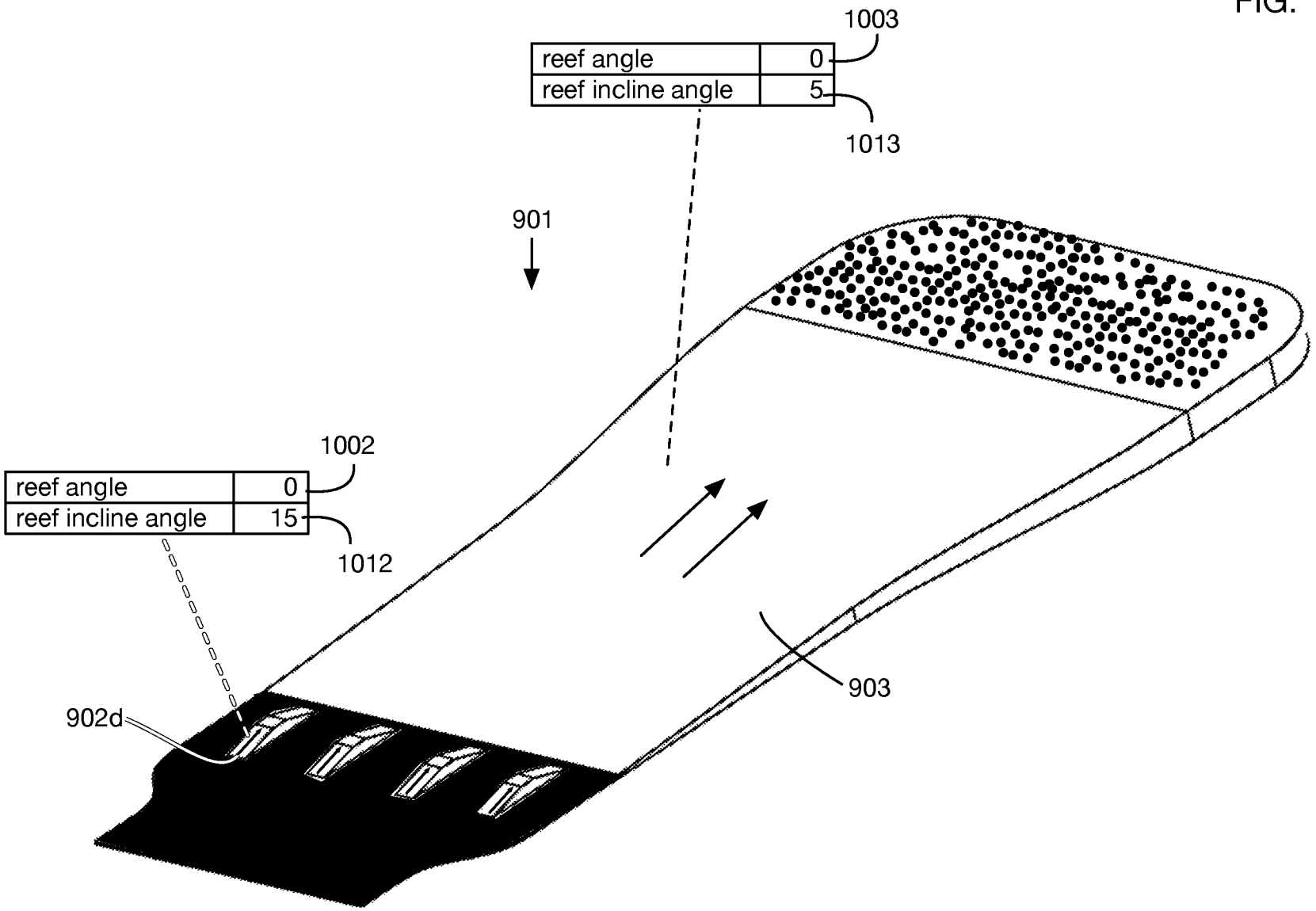
FIG. 10 shows a perspective view of the beginner basin of FIG. 9, with the reef angle and reef incline angle for each reef section.

FIG. 10 shows a perspective view of beginner basin 901, and shows illustrative reef angles and reef incline angles for the reef sections. The isolated takeoff reef sections (which are closest to the paddles), such as section 902*d*, have a reef angle 1002 of 0 degrees, and a reef incline angle 1012 of 15 degrees. In one or more embodiments, the takeoff reef section may have a reef incline angle between 5 degrees and 20 degrees, inclusive. The reef section 903 has a reef angle 1003 of 0 degrees, and a reef incline angle 1013 of 5 degrees. In one or more embodiments the reef section or sections further from the paddles than the takeoff sections may have a reef incline angle between 0 degrees and 10 degrees, inclusive.

Figure 11:
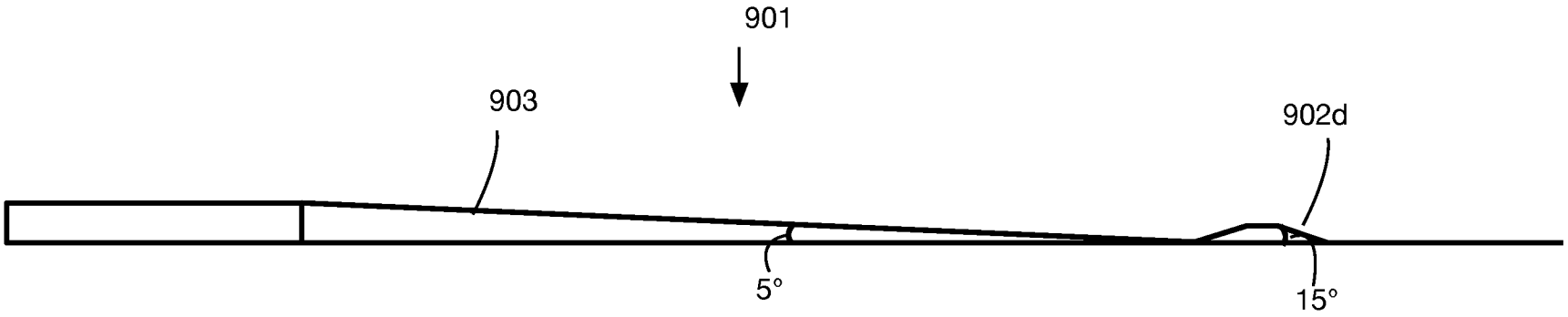
FIG. 11 shows a side cross section view of the beginner basin of FIG. 9, illustrating the reef incline angles.

FIG. 11 shows a side view of the beginner basin 901, illustrating the reef incline angles of the takeoff sections such as section 902*d*, and of the subsequent section 903.

Another innovation of one or more embodiments of the invention is the use of a modular reef system that allows reefs to be rapidly constructed, moved, and reconfigured. Existing wave pools use permanent reefs, constructed for example out of concrete, to create a specific contour of the bottom of the pool. Changing this type of permanent reef is a long and expensive process: the pool must be drained, the existing concrete reef must be demolished, a new concrete floor must be rebuilt, and then the pool must be refilled. The average downtime for such a change is 2 to 5 months, so in addition to the considerable construction costs, the wave pool earns no revenue during this time. As a result, changes to reef structures are rarely made, and existing pools are therefore unable to offer wave variety.

The inventors have developed a modular reef system that eliminates many of these disadvantages of permanent reefs. This modular system enables a wave pool operator to swap some modules to add new reef sections that produce specific wave features. The reef angle and reef incline angle can be changed for an entire reef, or just for selected sections, which allows an operator to fine tune the difficulty level of the wave. The reef configuration can be modified to offer opposite peel angles (for example to change a left breaking wave into a right breaking wave.) The width of tiles of the modular reef sections (described below) may be modified to allow for additional fine tuning of wave features. These soft tiles also provide additional user safety by providing protection against direct impacts with the reef, which is unknown in existing wave pools. All of these reef changes can be performed by draining the pool, moving or swapping reef modules, and then refilling the pool; the work can be completed in 2 to 3 days. This increased flexibility and much lower cost and downtime allows wave pool operators to reconfigure their pools as needed or desired to offer wave variety, to vary difficulty levels, and to configure a pool for a special event such as a tournament.

In one or more embodiments, the modular reef sections may be used for all reef sections of all basins, or for selected basins or selected reef sections. One or more embodiments may use a combination of modular reef sections and permanent or semi-permanent reef sections.

Figure 12:
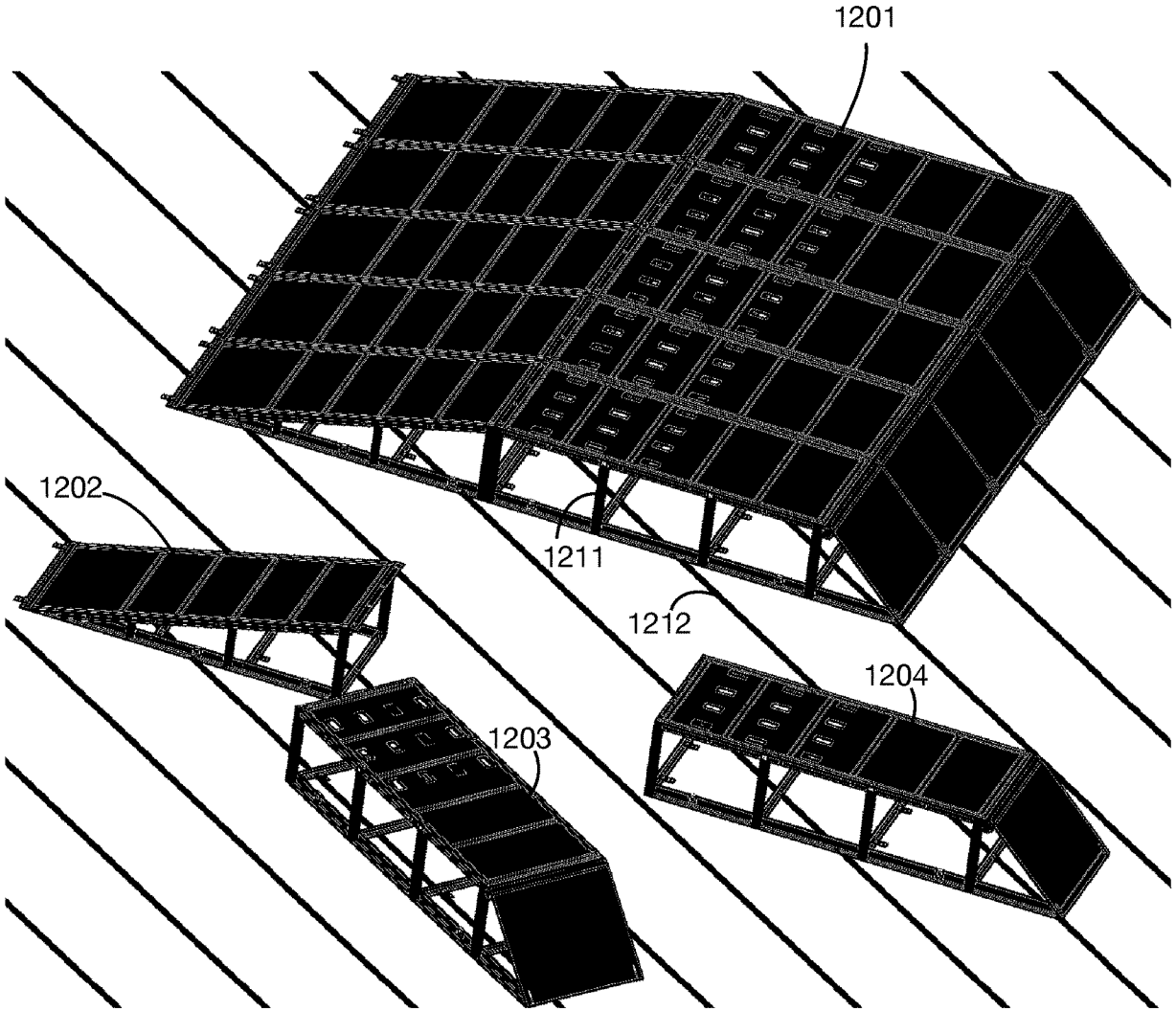
FIG. 12 shows illustrative embodiments of modular reef sections that may be used to create the reef structures of one or more embodiments of the invention.

FIG. 12 shows illustrative modular reef sections 1201, 1202, 1203, and 1204. In this embodiment, the modular reef structures have a frame, such as frame 1211 for reef section 1201, which may be constructed for example of galvanized steel. The frame may bolt directly onto the basin floor. Channels may be placed into the basin floor, such as channel 1212, and brackets attached to the frame may be detachably coupled to any desired channel in any location. For example, Unistrut™ channels may be embedded into the basin floor to serve as attachment points for the frames. In one or more embodiments, portions of the channels that are not covered by the reef structure may be covered to prevent injury to pool users. Tiles may be attached to the frame to form the reef faces and the tops of the reefs.

Figure 13:
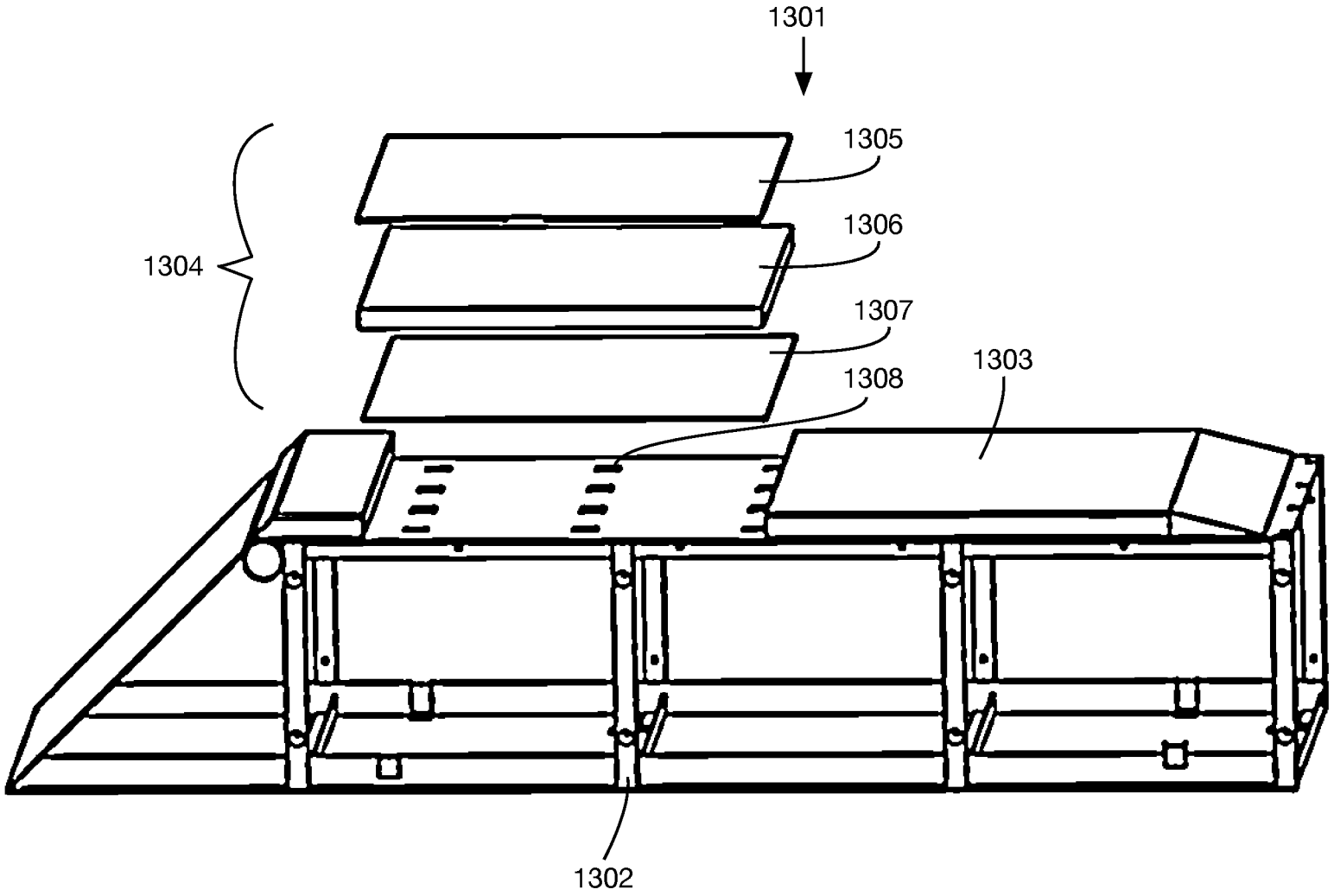
FIG. 13 shows an exploded view of an illustrative tile that may be used in a modular reef section.

FIG. 13 shows an illustrative modular reef with a frame 1302, and illustrative tiles 1303 and 1304 attached to the frame. (Tiles may be attached to any surface of the frame.) An exploded view is shown of tile 1304. This tile has a rigid bottom layer 1307, which may be made for example of PVC, ABS, or a fiberglass-like composite to provide the required strength for a mechanical anchoring system between the tiles and the reef frame, described below. The middle layer 1306 may be a padding element of a soft material such as rubber or foam; the density (durometer) and thickness may be selected for fine-tuning of the reef and for the desired safety profile. The top layer 1305 may also be of a soft material such as rubber or foam; it may provide a smooth surface finish and a color selected for esthetics or for visibility. In one or more embodiments, one or more tiles may have only the two layers 1306 and 1307. The layers 1306 and 1305 may comply for example with widely accepted ASTM standards used in playground flooring, or with other safety standards.

Figure 14:
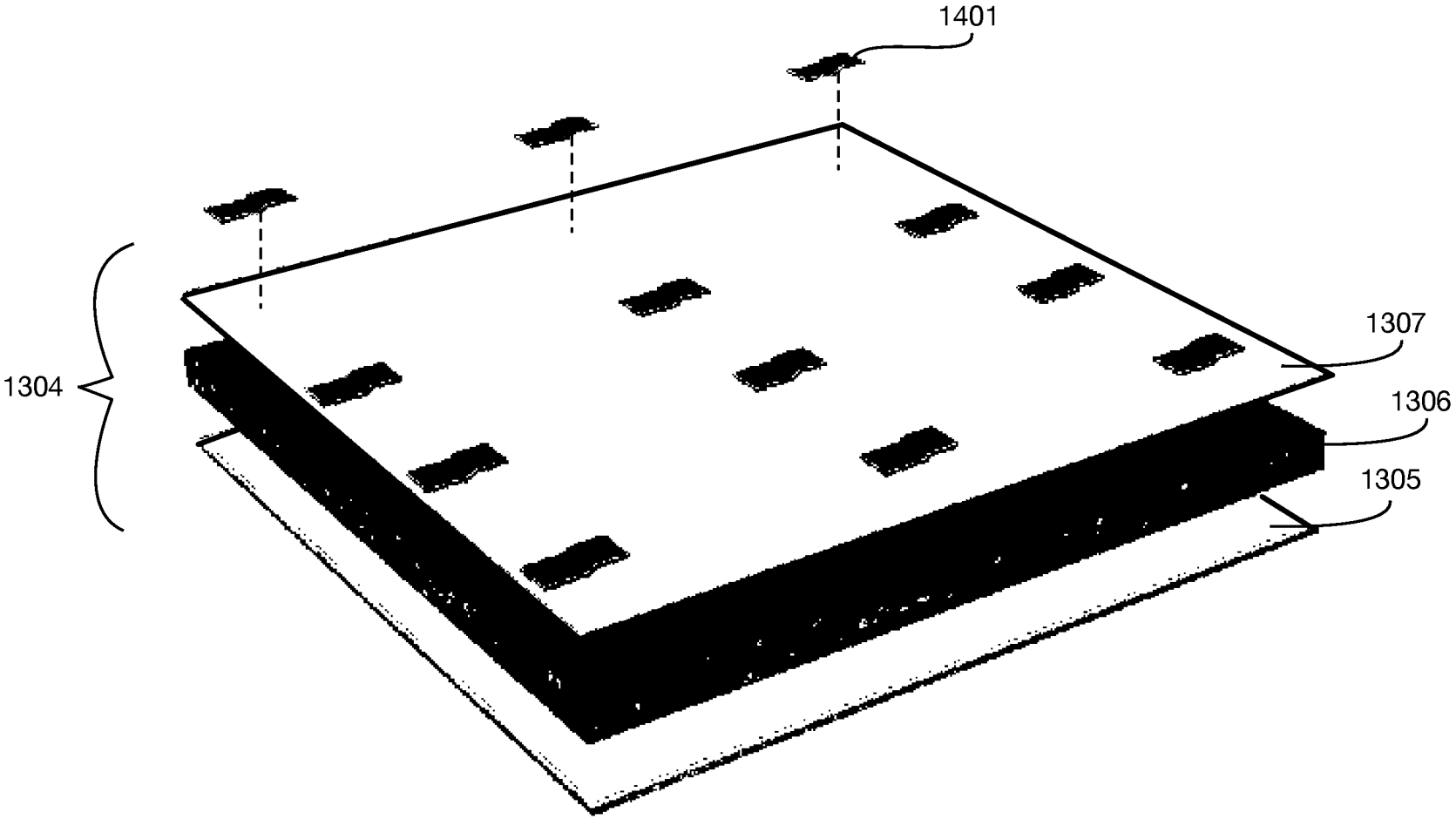
FIG. 14 shows the exploded tile of FIG. 13 from the bottom, illustrating a clip-in attachment system that may be used to attach the tile to a reef frame.

The reef frame 1302 may have slots such as slot 1308 that serve as attachment points for the tiles. FIG. 14 shows tile 1304 from the bottom. The bottom layer 1307 may have tabs attached to or integrated into the layer, such as tab 1401 (shown exploded from the layer 1307). These tabs may fit into the slots in the reef frame. The tiles may therefore be attached to the frame by sliding the tabs into the slots, where they may lock in place. This attachment mechanism allows tiles to be quickly replaced, either for repair or to change thickness or color. This replacement can be performed from the top side of the reef, without draining the pool and with minimal tools; tiles can therefore be replaced in minutes. Tabs such as tab 1401 may be made for example of a plastic or fiberglass-like material that may be bonded to the bottom layer 1307 using heat or RF-welding.

While the invention herein disclosed has been described by means of specific embodiments and applications thereof, numerous modifications and variations could be made thereto by those skilled in the art without departing from the scope of the invention set forth in the claims.

What is claimed is:

1. A wave generator pool with varying reef angles, comprising:

one or more basins configured to contain water;

one or more moveable paddles configured to be at least partially submerged in said water, wherein said one or more moveable paddles are associated with a longitudinal axis that lies in a horizontal plane;

one or more actuators coupled to said one or more moveable paddles and configured to move said one or more moveable paddles to generate a wave in each basin of said one or more basins, wherein said wave travels along a wave propagation axis; and a reef coupled to or part of a portion of a floor of said each basin, wherein said reef is configured to generate a change in said wave when said wave reaches said reef;

said reef comprises one or more reef sections;

each reef section of said one or more reef sections comprises a wave-facing surface in contact with said water; and each point of said wave-facing surface is associated with a tangent plane to said wave-facing surface at said each point;

a reef angle between a line of intersection between said tangent plane and said horizontal plane; and said longitudinal axis;

a reef incline angle between said tangent plane; and said horizontal plane;

wherein said reef angle is between 0 degrees and 90 degrees, inclusive; and said reef incline angle is between 0 degrees and 90 degrees, inclusive;

wherein a first basin of said one or more basins is associated with a first reef coupled to or part of a portion of the floor of said first basin;

said first reef comprises a first plurality of reef sections;

said first plurality of reef sections comprises a first reef section and a second reef section, wherein said first reef section is closer to said one or more moveable paddles than said second reef section;

said first reef section comprises a first point with an associated first reef angle and an associated first reef incline angle;

said second reef section comprises a second point with an associated second reef angle and an associated second reef incline angle;

said first reef angle is between 0 degrees and 20 degrees, inclusive; and, said second reef angle is between 65 degrees and 85 degrees, inclusive.

2. The wave generator pool with varying reef angles of claim 1, wherein said first reef incline angle is between 10 degrees and 20 degrees, inclusive; and, said second reef incline angle is between 3 degrees and 15 degrees, inclusive.

3. The wave generator pool with varying reef angles of claim 1, wherein said second reef angle is between 75 degrees and 80 degrees, inclusive.

4. The wave generator pool with varying reef angles of claim 3, wherein said second reef angle is 78 degrees.

5. The wave generator pool with varying reef angles of claim 4, wherein said first reef angle is 0 degrees.

6. The wave generator pool with varying reef angles of claim 1, wherein said first plurality of reef sections further comprises one or more subsequent sections, each subsequent section of said one or more subsequent sections comprising an associated subsequent section point with an associated subsequent section reef angle and an associated subsequent section reef incline angle;

said second reef section is closer to said one or more moveable paddles than said each subsequent section; and, an average subsequent section reef angle across said one or more subsequent sections is between 50 degrees and 65 degrees, inclusive.

7. The wave generator pool with varying reef angles of claim 6, wherein said first reef incline angle is between 10 degrees and 20 degrees;

said second reef incline angle is between 3 degrees and 15 degrees; and, an average subsequent section reef incline angle across said one or more subsequent sections is between 3 degrees and 10 degrees, inclusive.

8. The wave generator pool with varying reef angles of claim 1, wherein said one or more basins comprise said first basin on a first side of said one or more moveable paddles;

a second basin on a second side of said one or more moveable paddles, wherein said second basin is associated with a second reef coupled to or part of a portion of the floor of said second basin;

said one or more actuators are further configured to move said one or more moveable paddles in both directions along said wave propagation axis to generate a first wave that travels into said first basin and a second wave that travels into said second basin.

9. The wave generator pool with varying reef angles of claim 8, wherein a shape of said first reef is different from a shape of said second reef.

10. The wave generator pool with varying reef angles of claim 9, wherein said second reef comprises a second plurality of reef sections;

said second plurality of reef sections comprises a plurality of takeoff sections that are substantially a same shape;

substantially equidistant from said one or more moveable paddles; and isolated from each other.

11. The wave generator pool with varying reef angles of claim 10, wherein the reef angle associated with a point of the wave-facing surface of each takeoff section of said plurality of takeoff sections is 0 degrees.

12. The wave generator pool with varying reef angles of claim 11, wherein the reef incline angle associated with said point of the wave-facing surface of said each takeoff section of said plurality of takeoff sections is between 5 degrees and 20 degrees, inclusive.

13. The wave generator pool with varying reef angles of claim 11, wherein said second plurality of reef sections further comprises an additional reef section that is further from said one or more moveable paddles than said each takeoff section;

the reef angle associated with a point of the wave-facing surface of said additional reef section is 0 degrees; and, the reef incline angle associated with said point of the wave-facing surface of said additional reef section is between 0 and 10 degrees, inclusive.

14. The wave generator pool with varying reef angles of claim 1, wherein one or more of said one or more reef sections associated with at least one basin of said one or more basins comprises a frame detachably coupled to said floor of said at least one basin; and, a plurality of tiles detachably coupled to said frame.

15. The wave generator pool with varying reef angles of claim 14, wherein said frame is detachably coupled to one or more channels integrated into or coupled to said floor of said at least one basin.

16. The wave generator pool with varying reef angles of claim 14, wherein each tile of said plurality of tiles comprises one or more padding elements comprising rubber or foam.

17. The wave generator pool with varying reef angles of claim 16, wherein said frame comprises one or more slots;

said each tile further comprises a bottom layer comprising one or more tabs configured to slide into a corresponding slot of said one or more slots and detachably lock in place.

18. The wave generator pool with varying reef angles of claim 17, wherein said at least one basin of said one or more basins comprises all of said one or more basins; and, said one or more of said one or more reef sections comprises all of said one or more reef sections.

* * * * *